US006301726B1

(12) United States Patent
Pena

(10) Patent No.: US 6,301,726 B1
(45) Date of Patent: Oct. 16, 2001

(54) METHOD OF INSTALLING A BATHTUB

(76) Inventor: Robert Pena, 76 S. Village Ave., Rockville Centre, NY (US) 11570

( * ) Notice: Subject to any disclaimer, the term of this patent is extended or adjusted under 35 U.S.C. 154(b) by 0 days.

(21) Appl. No.: 09/721,680

(22) Filed: Nov. 27, 2000

(51) Int. Cl.[7] ..... A47K 3/02
(52) U.S. Cl. ..... 4/661; 4/580
(58) Field of Search ..... 4/580, 661

(56) References Cited

U.S. PATENT DOCUMENTS 1,861,495 * 6/1932 Gould ..... 4/580
2,853,714 * 9/1958 Darmstadt ..... 4/580
3,024,471 * 3/1962 Anderson ..... 4/580
3,460,167 * 8/1969 Benjamin ..... 4/480

* cited by examiner

*Primary Examiner*—Charles E. Phillips
(74) *Attorney, Agent, or Firm*—Myron Amer P.C.

(57) ABSTRACT

Preventing damage to the porcelain surface of a bathtub that is being installed by using an original equipment manufacture (OEM) peripheral flange to mount support rods for a protective cover draped over the bathtub which remains in place except for the short duration when a bottom now of tiles is set in place, the workpersons exercising the necessary care during this short duration to avoid chipping of the porcelain surface with inadvertently dropped tools or the like.

1 Claim, 3 Drawing Sheets

Fig. 1
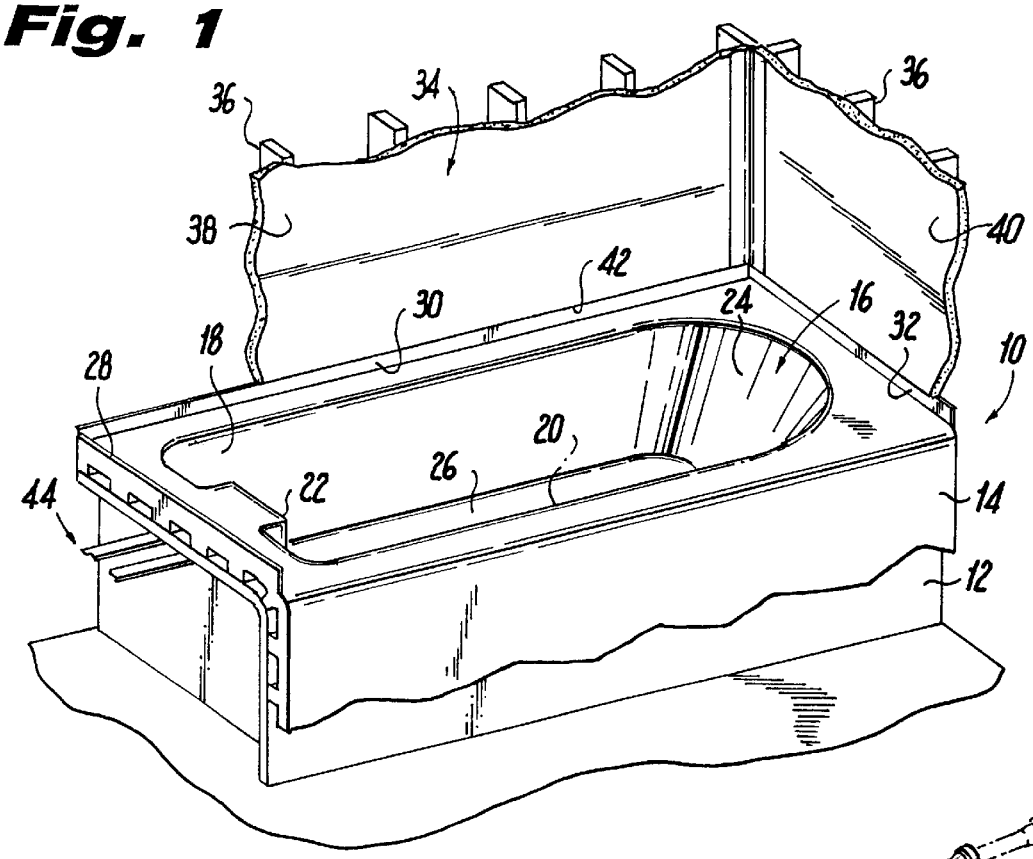
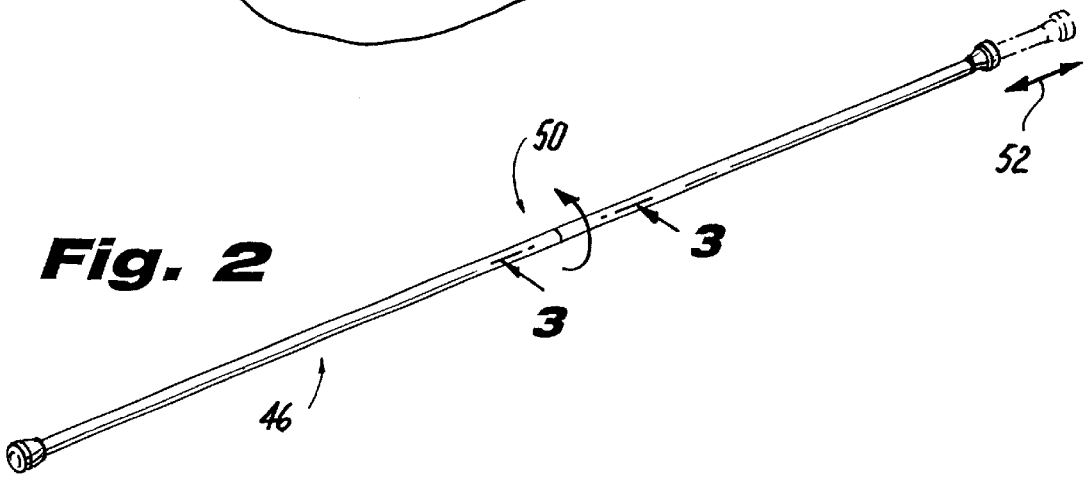
Fig. 2
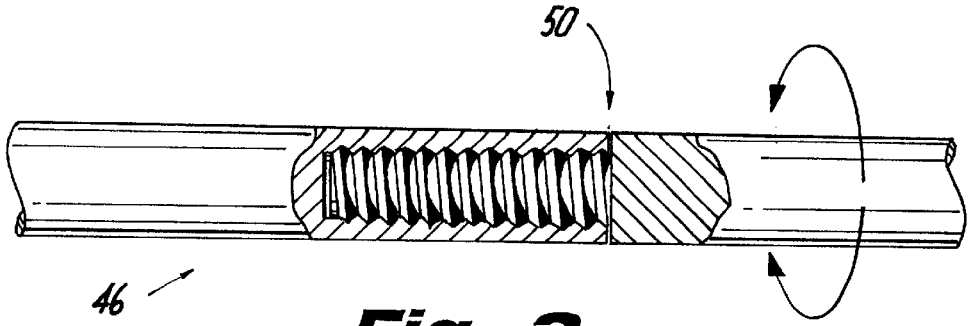
Fig. 3

METHOD OF INSTALLING A BATHTUB

The present invention relates generally to improvements in the installation of a bathtub, the improvements, more particularly, contributing to obviating workperson-caused chipping or other damage to the ceramic bathtub surface during the installation.

In the building of a new house, for example, it is standard practice to install the bathtub at approximately the time of completion of the rough framing and flooring and prior to the installation of the finished wall and floor surfaces. This permits the tub to be "built-in" to the wall. While such a procedure is highly desirable from an aesthetic point of view, it is undesirable from certain other standpoints, in view of the fact that these finishing operations involve the use of plaster, lath, paint, trim, tile, among other materials, by plasterers, carpenters and other workmen.

When working within a confined area such as would be the case in most bathrooms, it is impossible for the workmen to accomplish their jobs without dropping bits of plaster or dripping paint. In addition, tools and other materials used by the workmen are frequently dropped, sometimes landing with great force. Further, it is necessary for workmen to actually step into the bathtub in order to properly position themselves to perform certain parts of the finishing operation. Consequently, the highly polished vitreous surface of the bathtub is exposed to damage during the whole period of time following installation until the finishing operation has been completed. This interval of time is usually considerable with the result that the bathtub, being a reservoir, collects an accumulation of material of this nature that is extremely difficult to remove prior to actual use thereof. Additionally, during this time interval, there is a great likelihood that the finished surface of the fixture will become cracked or chipped due to the falling tools.

In the prior art, the efforts made to overcome these difficulties involve the use of heavier type paper, preformed in two or more pieces, and fitted to the configuration of the bathtub and supposedly capable of being removed for use on another job. These pieces are usually held together by adhesive tape but in some cases one such piece is secured to the rough flooring, where it remains after the finishing operation.

While these devices of the prior art afford some additional protection against falling objects and since parts are joined, it is highly likely that separation and tears will occur with the result that blemishes or cracks will appear on the surface of the bathtub and still necessitate the use of a "clean-up" crew following the finishing operation. Further, these tears and separations minimize the possibility of reuse of all or some of the pieces, involving an additional cost in replacing the same.

Broadly, it is an object to provide a method of installing the bathtub overcoming the foregoing and other shortcomings of the prior art.

More particularly, it is an object to advantageously use the Original Equipment Manufacture (OEM) structural features of the bathtub to drape a protective cover over the bathtub for all but a short duration of the installation process, which significantly contributes to obviating any mishap occurring to the bathtub, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a partial perspective view of a site of a bathtub installation illustrating the bathtub in a preliminary condition of installation;

FIGS. 2 and 3 are respectively front elevational and perspective isolated views of components used in the installation of the bathtub of FIG. 1;

Figure 4:
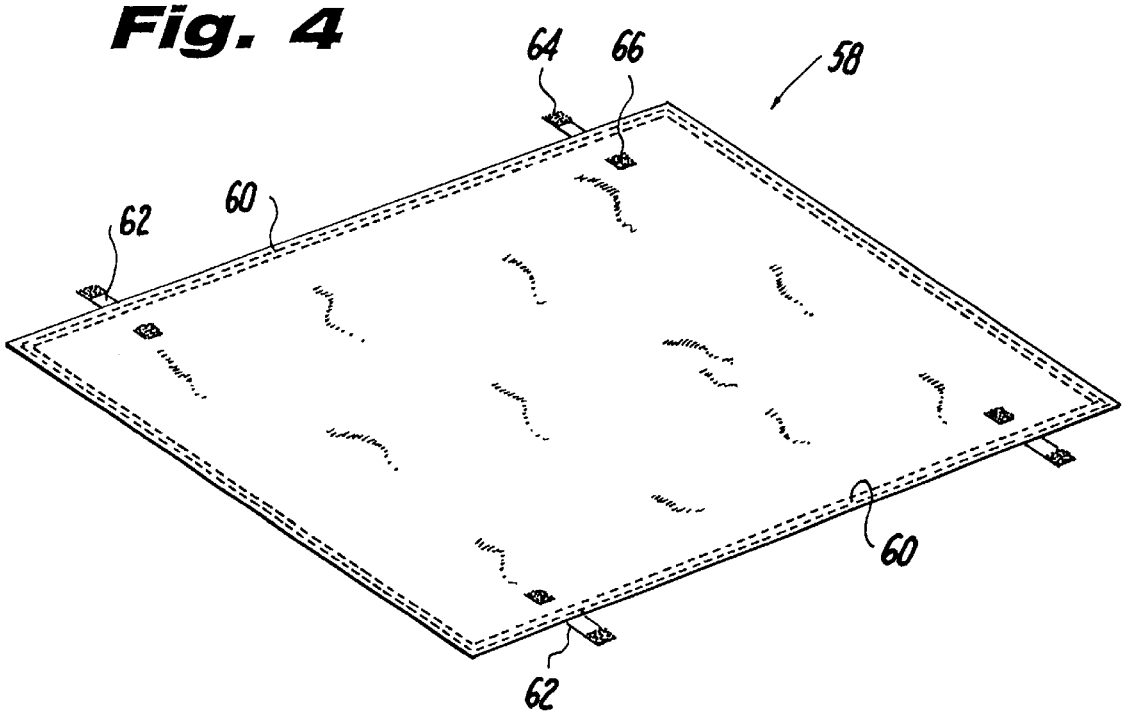
FIGS. 4, 5 and 6 and 7 are similar perspective views of the installation site of FIG. 1, but illustrating the bathtub at progressive subsequent conditions of installation.

The illustrated bathtub, generally designated 10, will be understood to be a known Original Equipment Manufacture (OEM) that is sized and shaped for bathing use and, to this end, consists of a body 12 of metal construction material and having applied thereto in a known manner an external surface, generally designated 14, of ceramic construction material so that a bathing area 16 is bounded by a smooth ceramic rear wall 18, and similarly smooth front 20, opposite left 22 and right 24 walls and a bottom 26. It is important to note, for reasons subsequently to be explained, that the OEM bathtub has left exposed an upstanding peripheral metal flange, about ¾ of an inch high, with a length portion 28 along its left side, a length portion 30 along its rear, and a length portion 32 along its right side.

The installation site, generally designated 34, construction-wise consists of spaced apart studs, individually and collectively designated 36, to which there are appropriated attached sheet rock panels, including a rear panel 38, and opposite similar side panels 40, only the right panel being shown in FIG. 1 so as not to obscure the left side of bathtub 10. The bottom panel edges 42 are in vertically aligned contact with, or optionally positioned slightly above the upper edge of the flange length portions 28, 30 and 32, so that the panels 38, 40 and flange length portions 28, 30 and 32 cooperate to serve as planar horizontally oriented walls which bound the installation site 34.

The installation of the bathtub 10 contemplates, among other items of convenience, providing an overhead shower head (not shown) optionally an overhead light (not shown), and completing plumbing connections, collectively designated 44, only partially shown, for filling and draining water in the use of the bathtub 10. During the aforesaid, commonly referred in the parlance of the trade as "finishing work," work personnel must frequently enter into and exit from the bathtub 10, the former to have within reach the sites of installation of the convenience items, and it is when standing and working while in the bathtub 10 that tools, such as a hammer or the like, can inadvertently slip and chip the ceramic bathtub surface 14, necessitating a very expensive repair.

To obviate the consequence of a chipped or otherwise caused damage to the bathtub surface 14, use is made of the component shown in isolated perspective in FIG. 2, which consists of similar extension support rods 46 and 48 each of a type having threadably cooperating threads at a medial location 50, which when unthreaded cause, in a known manner, axial extension 52 in the size of the rods 46, 48 so that when positioned, as contemplated in accordance with the present invention, each rod is firmly wedged in spanning relation between the flange length portions 28 and 32, the rod 46 being along and slightly above the rear bathtub ledge 54 and rod 48 being along and slightly above the front bathtub ledge 56.

Cooperating with the positioned support rods 46, 48, is a bathtub rectangular shaped protective cover 58 sized to drape over the bathtub 10 and particularly to assume the shape of the bathing area 16, the cover being of a canvas or similar construction material preferably with internal padding of a nature effective to absorb the impact of a dropped tool. Stitched, as at 60, so as to extend laterally of the cover 58 are strips, individually and collectively designated 62, which, using cooperating loop-type and hook-type fasteners, as at 64 and 66, form closed loops about the support rods 46 and 48, in the draped condition of the cover 58 over the bathtub 10.

Figure 5:
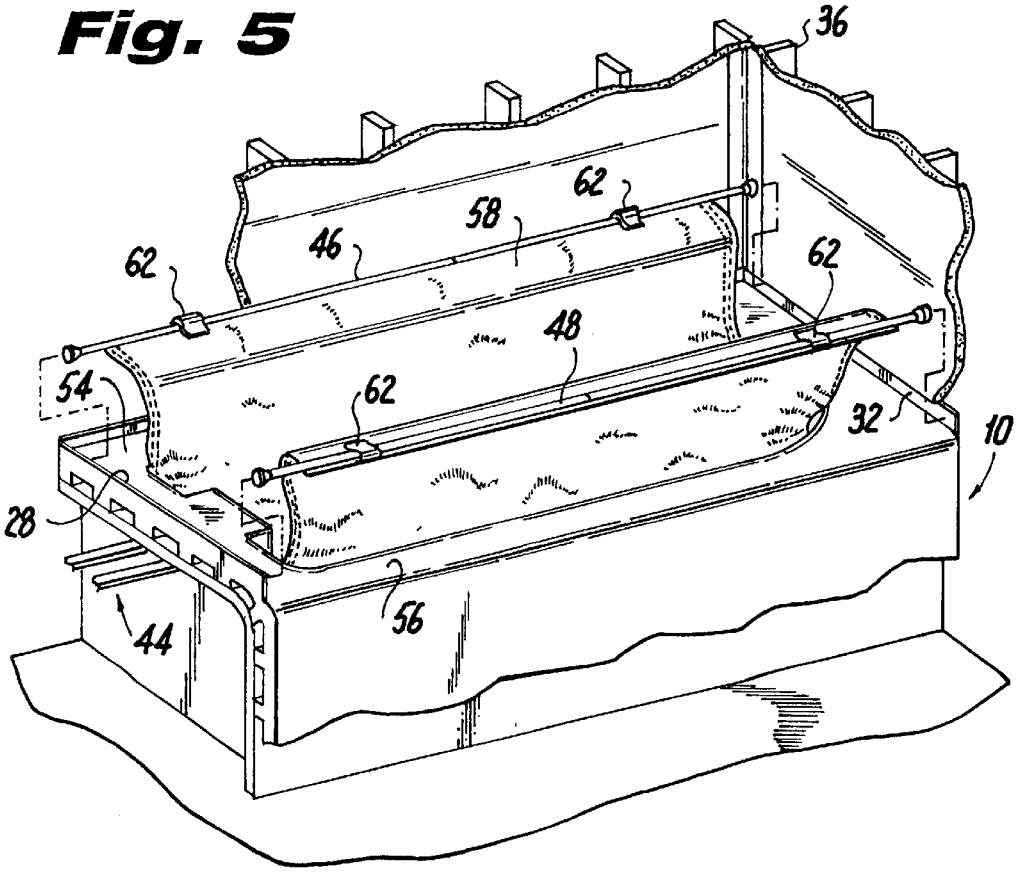
Figure 6:
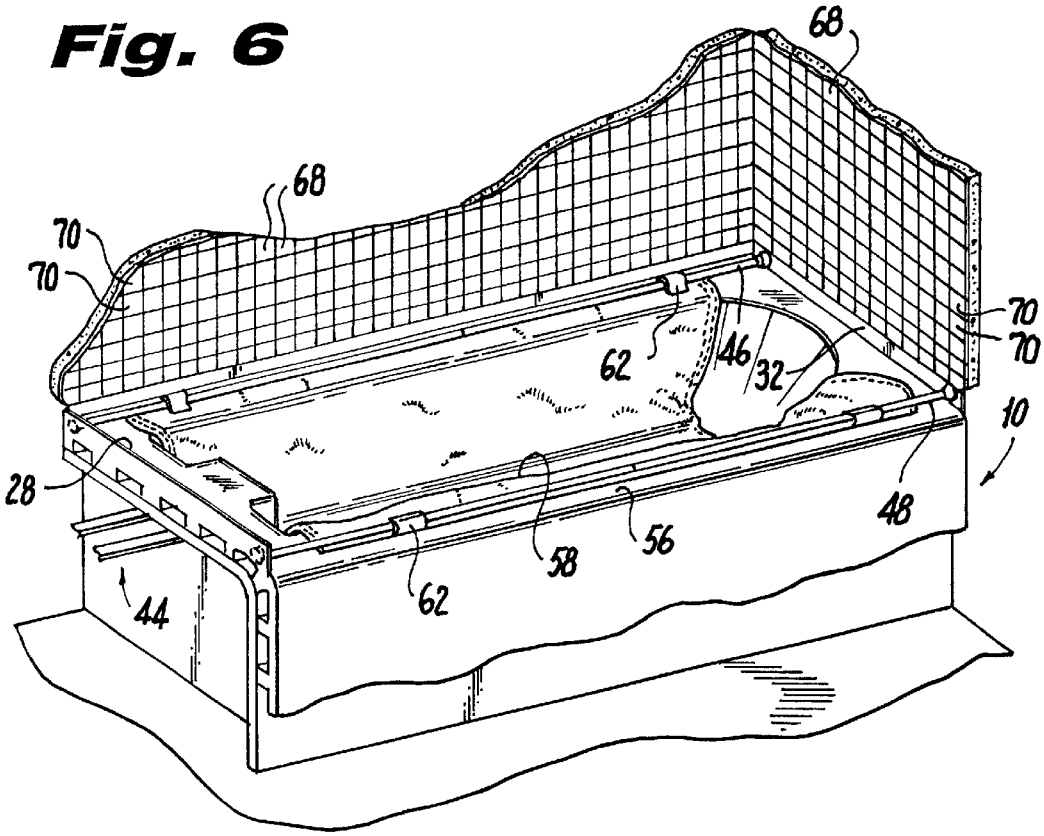
Figure 7:
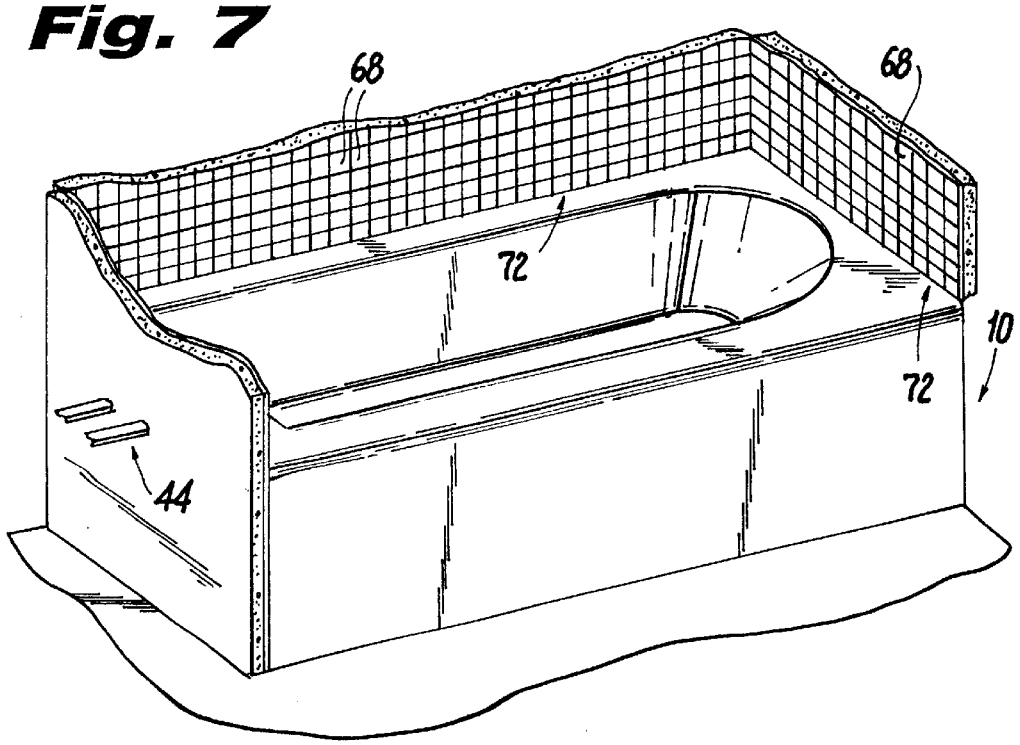

As best understood from FIG. 5, after the finishing work is completed except for the walls bounding the installation side 34, these walls are tiled, using grout and tiles, individually and collectively designated 68, in horizontally oriented top to bottom rows 70, but not for the very bottom row, as at 72, which is left temporarily untiled in accordance with the installation method of the present invention. Before tiling the last row or the untiled space 72, the cover 58 is released from the rods 46 and 48 and the rods, in turn, removed from their wedged positions between the flange length portions 28 and 32, thus allowing access to the untiled space 72. The cover 58 can be permitted to remain on the bathtub bottom 26 to stand on or removed, in either circumstance the work person will be exercising extreme care to avoid any mishap that could cause an expensive repair during the relatively short interval of time consumed in tiling the remaining untiled space 72, it being a consequence of the method of bathtub installation according to the present invention that the bathtub is unprotected against work person-caused damage only during this short interval of time.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For a porcelain surfaced metal bathtub having an upstanding flange of a nominal height in surrounding relation about a rear and opposite sides of said bathtub installed in a site of use forwardly of a rear wall and between opposite side walls, an improved method of tiling said site rear and side walls while obviating inadvertent chipping of said bathtub porcelain surface comprising the steps of:

a. installing said flanged porcelain-surfaced bathtub in said site of use;

b. disposing in horizontal orientation at least two spaced apart support rods in extending relation between said opposite side flanges, one said support rods being disposed adjacent said site rear wall and said other support rods being disposed above a front ledge of said bathtub;

c. supporting in spanning relation between said disposed support rods, a shock-absorbing cover having an operative position draped over said bathtub porcelain surface;

d. tiling said site rear and side walls to a selected lower extent slightly above said upstanding flange;

e. removing said support rods and cover to make accessible untiled wall surface at said tiled wall lower extent; and f. completing the tiling of said untiled wall surface;

whereby said bathtub porcelain surface is unprotected by said cover only during said completion of said tiling to contribute to obviating inadvertent chipping thereof.

* * * * *